United States Patent [19]

Eme, deceased et al.

[11] 4,222,624

[45] Sep. 16, 1980

[54] INTERFACE WAFER FOR PRINTED CIRCUIT BOARD

[75] Inventors: Robert Eme, deceased, late of Chicago, Ill., by Elain M. Eme, administratrix; Lloyd P. Schuman, Chicago, Ill.

[73] Assignee: Midway Mfg. Co., Franklin Park, Ill.

[21] Appl. No.: 16,886

[22] Filed: Mar. 2, 1979

[51] Int. Cl.[3] ..... H01R 13/54

[52] U.S. Cl. ..... 339/91 R; 339/17 L; 339/75 M

[58] Field of Search ..... 339/17 L, 17 LC, 17 LM, 339/75 M, 75 MP, 91 R, 176 MP, 79

[56] References Cited

U.S. PATENT DOCUMENTS

| | | | |
|---|---|---|---|
| 3,688,243 | 8/1972 | Yamada et al. | 339/91 R X |
| 3,706,954 | 12/1972 | Krafthefer | 339/75 M X |
| 3,824,523 | 7/1974 | McGhee | 339/91 R X |
| 3,933,406 | 1/1976 | Cameron et al. | 339/91 R |

*Primary Examiner*—Roy Lake
*Assistant Examiner*—Eugene F. Desmond
*Attorney, Agent, or Firm*—Robert E. Wagner; Gerald T. Shekleton

[57] ABSTRACT

The electric interface of the subject invention physically and electrically couples an electric connector to a printed circuit board, and employs one or more projections on the underside of the interface to engage a shoulder on the top of the connector for positively locking the interface and the connector together. This positive locking mechanism may be easily disengaged by pressing on a lever arm on the top of the interface which employs its mechanical advantage to disengage the interface from the connector and allow separation from the connector.

1 Claim, 6 Drawing Figures

INTERFACE WAFER FOR PRINTED CIRCUIT BOARD

BACKGROUND OF THE INVENTION

The present invention relates to improvements in connectors for printed circuit boards and, more particularly, to an interface wafer for preventing inadvertent separation of such connectors from a circuit board or other connector.

The ever-increasing use of equipment employing electronic circuitry has caused a substantial increase in the utilization of integrated circuits. Such circuits may take the form of a board upon which the electronic circuitry is printed and from which contact members or conductors extend outward from the sides in the plane of the board. These circuit boards are generally electrically linked to one another, to other electronic components and to a power source by connectors which generally utilize the resilient pressure of metal terminals mounted within the connector body against conductors soldered to and projecting from the circuit board for firm electrical contact. In some situations, however, where the equipment is subject to stress or strain, such a connection can result in the accidental separation of a circuit board and associated connector with a subsequent loss of electrical contact.

The use of printed circuit boards has become economically attractive for several reasons. They are relatively inexpensive to manufacture and assemble, and printed circuit boards greatly reduce material and labor costs associated with wiring electronic equipment. In fact, it has become economically sound to replace an entire defective circuit board rather than individual components, as a result of the high cost of labor necessary to locate and repair or replace the defective component. The advantages inherent in the use of circuit boards are not fully realized, however, since methods presently employed to mechanically couple circuit boards are not conducive to their efficient removal and replacement, and the cumulative labor cost involved in such an operation can be substantial. Those devices which do attempt to aid in the removal of defective circuit boards, e.g., the connector taught by U.S. Pat. No. 3,706,954, are cumbersome because to remove the board, one must pry open the mechanism which locks the connector and the circuit board together, which is a fairly difficult operation that may require the use of a special tool or protective covering for the hands.

SUMMARY OF THE INVENTION

It is, therefore, an object of the present invention to provide a means of mechanically and efficiently locking the connector to a circuit board or other connector independent of the resilient pressure between the terminals and the conductors.

It is a further object of the present invention to provide a means for the efficient removal and replacement of defective circuit boards.

In accordance with the objects of this invention, the inventive interface wafer comprises a body section and an engaging member, the latter comprising an arm integrally joined to the body section in cantilever fashion. As in most intermediate connectors, a plurality of equally spaced parallel conductor pins protrude from either side of the body section. One end of each of these pin conductors may be secured to the appropriate circuitry by solder sonnection, and the opposite end inserted, bayonet-style, into one of a plurality of openings in the connector body for joining the inventive interface wafer and connector. These openings allow electrical contact with mating terminals for subsequent electrical connection with a circuit board, connector or other appropriate component. A flex portion is formed on the engaging member by channels providing a discontinuity in the engaging member and defining a central portion of the member. A projection or depending ledge, preferably with one or both of the leading and trailing edges or ends chamfered or beveled, is formed on the underside of the flex portion of the inventive interface wafer, for the engagement of a shoulder or ledge formed on the top of the connector. When engaged, a mechanical lock of the inventive interface wafer and a connector physically couples the components and/or printed circuit board to which each is connected. The connector shoulder may also have a chamfered edge on a leading surface of the shoulder. An inclined lever or arm is formed integrally on the flex portion extending upwardly at an acute angle, allowing for the easy disengagement of the interface wafer and the connector with the manual application of a downward force to the unsupported end of the lever arm. Such a force elevates the parallel projections on the underside of the engaging member over the ledge on top of the connector to allow for the easy disengagement of the positive locking device.

Further objects of the invention, together with additional features contributing thereto and advantages accruing therefrom, will be apparent from the following detailed description of one embodiment of the invention when read in conjunction with the accompanying drawings, wherein:

DESCRIPTION OF THE INVENTION

Figure 1:
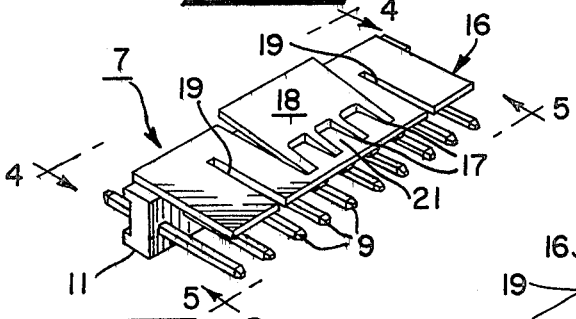
FIG. 1 is a perspective view of one embodiment of the inventive interface wafer.
Figure 2:
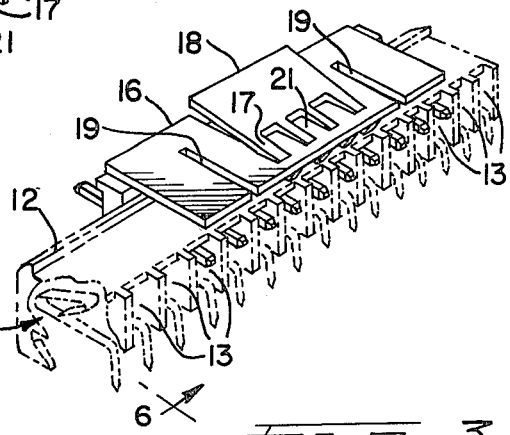
FIG. 2 is a perspective view of the inventive interface wafer of FIG. 1 mechanically locked with a connector assembly shown in dotted lines.
Figure 6:
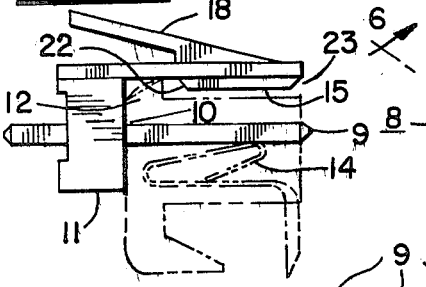

Referring now in detail to the drawings, and in particular to FIG. 1, the interface wafer 7 of the subject invention comprises an engaging member 16 shown as a cantilever arm or horizontal plate, which extends in cantilever fashion from one end of a supporting base section 11 to which it is integrally joined. The engaging member is divided into three portions by a pair of open channels 19, each extending to a point spaced from the base section 11 and defining a central flex portion 25. Extending from flex portion 25 at an acute angle is an inclined lever arm 18 at such a height as will permit its manual depression to sufficiently raise the flex portion 25 and easily disconnect the interface wafer from an associated connector or circuit board, as will be described. At least one, and preferably a series of spaced angled braces or ribs 17 join the lever arm with engaging member 16 and reinforces their union while allowing a flexing movement. Each rib 17 is spaced from another by a depression 21, preferably in the same plane as engaging member 16 (FIG. 3).

In some applications, a rectangular bar positioned perpendicular to the axis of the pins has proven satisfactory. However, in the preferred embodiment, a series of generally rectangular locking projections 15 extends from the underside of the engaging member 16 disposed parallel to the axis of the pins 9, thereby providing a plurality of independent surfaces for engagement with an associated ledge surface of a connector. Locking projections 15 are preferably beveled or chamfered on each of its leading end or edge 23 and trailing end or edge 22 to provide a more facile locking and release operation, and are formed on the lever arm 18 to allow trailing end 22 of each projection to butt up against shoulder or ledge 12 and securely hold the shoulder 12 to maintain electrical connection, as will be described. As stated above, parallel slots or grooves 19 cut into the engaging member 16 on either side of the inclined lever arm 18 define a flex portion of engaging member 16 which will flex upward when a manual downward force is applied to the unsupported upper end of inclined lever arm 18 (FIGS. 1 and 3). The unsupported end of lever arm 18 is disposed at a height which will allow engaging member 16 to be elevated sufficiently to disengage with an associated connector on the depression of lever arm 18. A series of parallel spaced slots 24 are cut in the engaging member 16 directly underneath the inclined lever arm 18 and in the plane of the plate 16. The bars 20 remaining allow a more facile flexing action of the engaging member 16, while providing sufficient strength for the pivotal engaging member 16. In this manner, the strength of the engaging member 16 is retained, and yet it can still flex sufficiently and easily for the positive engagement and disengagement of associated connectors.

Figure 3:
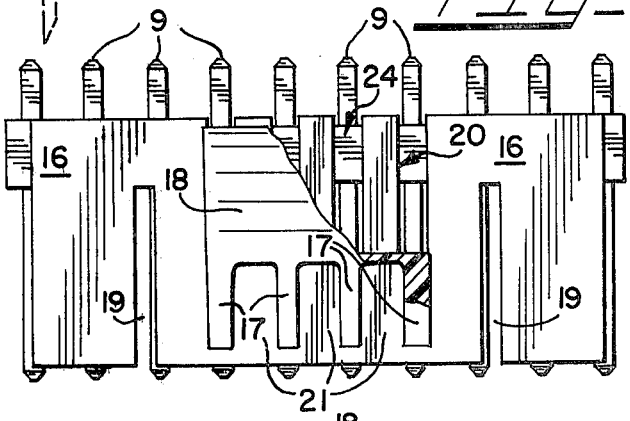
FIG. 3 is a top view of the inventive interface wafer of FIG. 1, partially cut away to show the underlying structural members.
Figure 4:
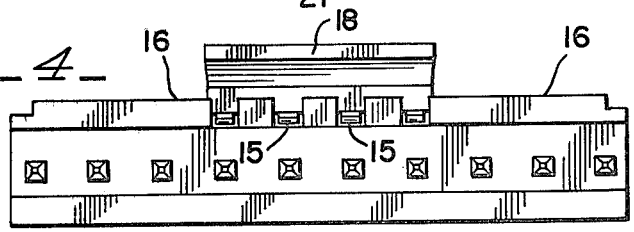
FIG. 4 is a rear elevational view of the inventive interface wafer taken along the line 4—4 of FIG. 1.
Figure 5:
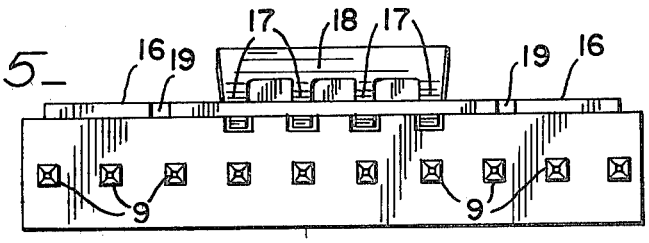
FIG. 5 is a front elevational view of the inventive interface wafer taken along the line 5—5 of FIG. 1; and, FIG. 6 is a side view of the inventive interface wafer and connector assembly in dotted lines of FIG. 2 mechanically locked together and taken along the line 6—6 of FIG. 2.

A plurality of parallel pins or conductors 9 extend on both sides of the base section 11 of the interface wafer 7, for insertion into openings 10 in the connector 8 when the interface wafer 7 and connector 8 are joined (FIGS. 1 and 3).

The connector 8 to which the interface wafer 7 is to be joined generally comprises a series of recesses 13 in which resilient terminals 14 are located. Terminals 14 may be fabricated from conductive material formed in a resilient coil configuration, although any other suitable terminal may be employed, as desired. For purposes of understanding the subject invention, it is only essential that when pin 9 is properly inserted into opening 10, electrical contact with the particular terminal is made. The connector 8 shown in the drawings has a shoulder or ledge 12 on an upper side, appearing somewhat similar to a right triangle presenting its hypotenuse to the interface-engaging side. However, any shoulder of a shape presenting a positive locking surface for contact with projection 15 is considered within the scope of the invention. Joinder and locking of the connector 8 and interface wafer 7 is made by insertion of pins 9 into openings 10 and pressing the connector 8 and interface wafer 7 together until projections 15 engage and lock onto ledge 12. With leading edges or projection 15 chamfered, a positive engagement and locking action, as well as an easy disengagement of the connector 8 and interface wafer 7, is possible.

The interface wafer 7 and the connector 8 are disengaged by depressing the unsupported end of the inclined arm or lever 18. This action elevates the flex portion of the engaging member 16 of the interface wafer 7 and the projection 15. On rising, the chamfered trailing end 22 of the engaging member 16 allows projection 15 on the interface wafer 7 to conveniently and easily disengage from the shoulder 12 on the top of the connector 8 and release the interface wafer 7 from the connector 8.

Upon a consideration of the foregoing, it will become obvious to those skilled in the art that various modifications may be made without departing from the invention embodied herein. Therefore, only such limitations should be imposed as are indicated by the spirit and scope of the appended claims.

I claim:

1. A locking interface wafter for preventing the physical and electrical separation of a connector means and a printed circuit board, said interface wafer comprising a body section, an engaging member attached to said body section by a first supported side with a second unsupported side extending out from said body section, at least one conductor means anchored in said body section and being electrically connectable to said connector means on a first end and to an electronic component on an opposing end, said engaging means including a flexible portion for quickly and efficiently disengaging and positively locking said interface wafer to said connector means, said flexible portion being defined by slots on said engaging member extending from a point proximate to said body section and opening onto said second unsupported side, said slots allowing limited angular motion of said flexible portion out of the plane of said engaging member, said flexible portion having an inclined lever arm extending at an acute angle above said spaced members, said inclined lever arm being secured to said flexible portion by a plurality of angled braces, said inclined lever arm having an elevated end portion for manual depression by a user, a projection on a side of said flexible portion opposite said inclined lever arm, a ledge on said connector means, said ledge being releasably mateable with said projection in a positive locking action, said projection being easily disengageable with said ledge on the depression of said inclined lever arm to cause said projection to rise over said ledge and allow said connector means to be easily withdrawn from engagement with said interface wafer.

* * * * *